United States Patent [19]

Rowan

[11] 4,381,725

[45] May 3, 1983

[54] ACTUATORS FOR SMALL SAILING CRAFT

[76] Inventor: James P. Rowan, 15923 Scandia Rd. Northeast, Poulsbo, Wash. 98370

[21] Appl. No.: 250,584

[22] Filed: Apr. 3, 1981

[51] Int. Cl.[3] ..... B63B 39/06

[52] U.S. Cl. ..... 114/126

[58] Field of Search ..... 114/121–126, 114/127–129, 152

[56] References Cited

U.S. PATENT DOCUMENTS 471,212 3/1892 Emery ..... 114/122

3,934,534 1/1976 Larsh ..... 114/124

*Primary Examiner*—Trygve M. Blix

*Assistant Examiner*—Jesus D. Sotelo

*Attorney, Agent, or Firm*—Seed, Berry, Vernon & Baynham

[57] ABSTRACT

This invention relates to actuators for small sailing craft. Fins extend downwardly from opposite sides of the craft and pivot together when the craft lists. The pivoting tends to right the craft. When righted, the fins function like centerboards to stabilize the craft. Preferably, the fins are linked to a pendulum which responds to the listing of the craft.

8 Claims, 7 Drawing Figures

ACTUATORS FOR SMALL SAILING CRAFT

TECHNICAL FIELD

This invention relates to novel actuators for providing stability and self-righting capacity to a small sailing craft. Fins project downwardly from opposite sides of the craft and pivot simultaneously when the craft lists.

BACKGROUND ART

To sail a small craft usually requires use of either a long centerboard or an outrigger to counterbalance the sail. Both these alternatives present problems to use. The centerboard is unwieldly and impairs sailing in shallow water or beaching the craft. The outrigger converts the craft into a catamaran in effect. Both these alternatives provide stability; neither provides self-righting capacity.

In U.S. Pat. No. 2,752,874, Held discloses a boat stabilizer which will minimize rocking and pitching of the boat. This device is yet another alternative to the centerboard or outrigger, but it fails to provide self-righting capacity.

U.S. Pat. Nos. 421,008 (Martin); 2,998,791 (Light); and 4,082,053 (Woodward) disclose three means for controlling a boat. The functions of rudders and centerboards are combined to improve the performance of the boat. Again, these devices fail to teach means to self-right the small craft. Each is merely an improvement to the steering mechanism of a boat.

DISCLOSURE OF INVENTION

To provide stability and self-righting capacity to a small craft, a novel feature of this invention is actuators having a pair of fins pivotally mounted on opposite sides of the craft to project downwardly into the water and to act like centerboards. Means, such as a pendulum, connect the two fins together so that they pivot simultaneously when the craft lists. By pivoting, the fins provide automatic self-righting capacity to the craft by altering the angle of attack for the fins so that force to right the craft is developed. Thus, with a simple and inexpensive means, a small craft can be made to sail more easily. The actuators of this invention may be retrofit to a canoe to allow it to be sailed. Because the fins are retractable, they will not interfere with beaching the craft.

BEST MODE FOR CARRYING OUT THE INVENTION

Figure 1:
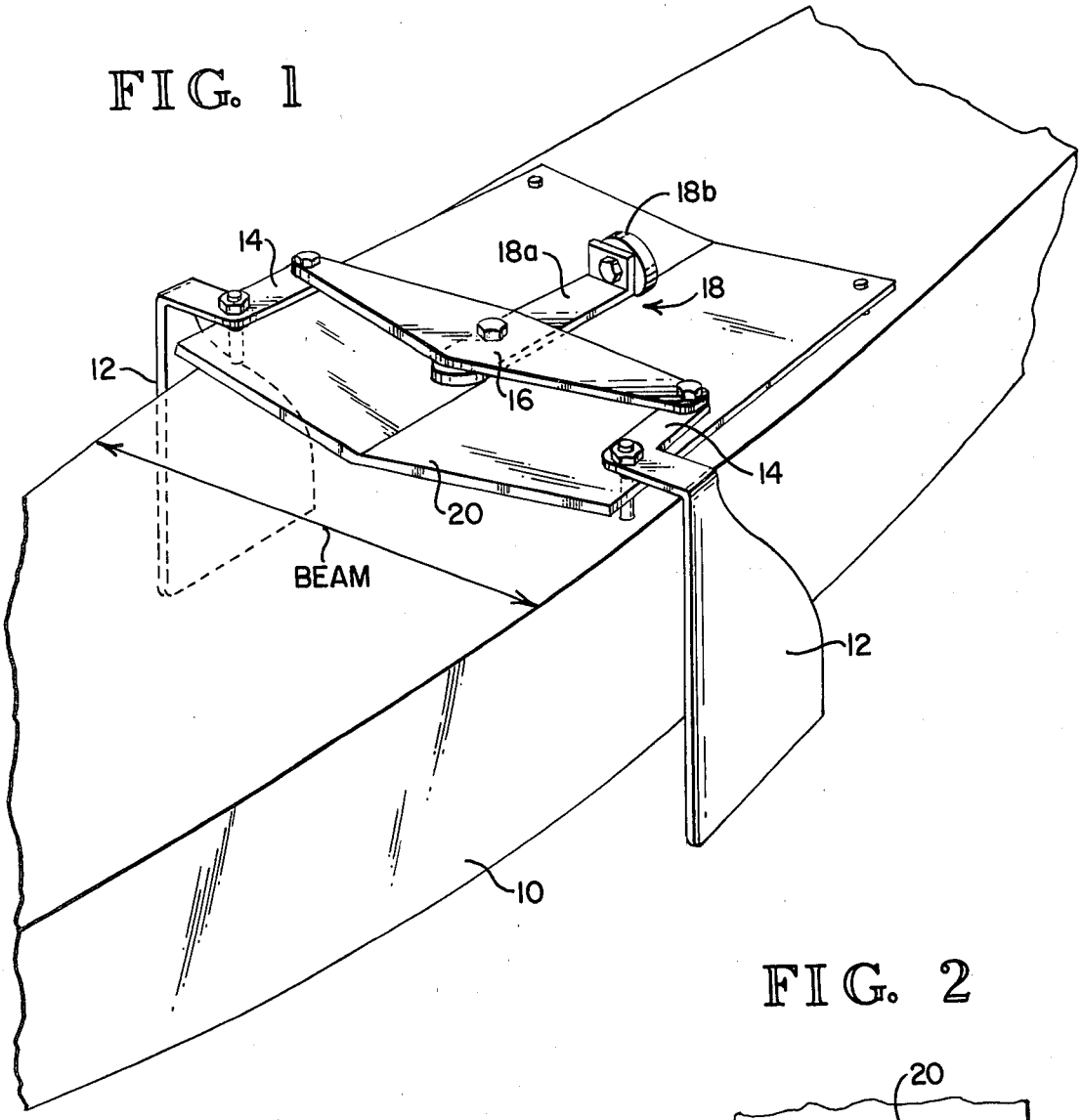
FIG. 1 is a perspective of the actuators of this invention.
Figure 2:
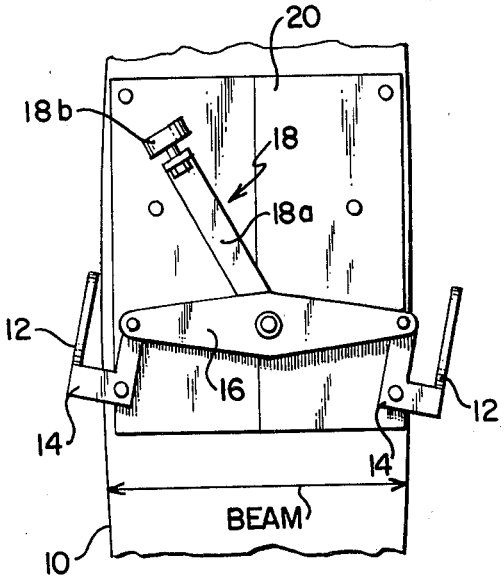
FIG. 2 is a top plan of the actuators of FIG. 1.
Figure 3:
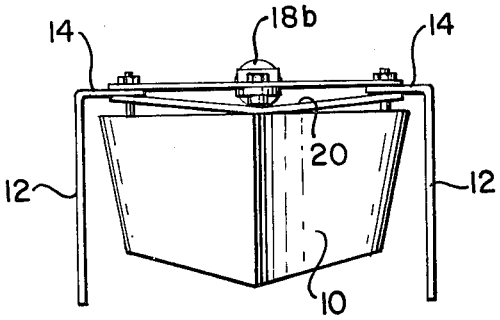
FIG. 3 is an elevation from the bow of a boat, showing the actuators of FIG. 1.
Figure 7:
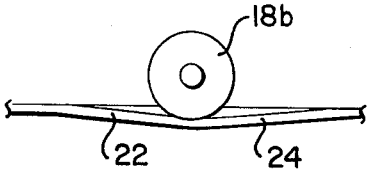
FIG. 7 is a detail of a preferred dihedral in which the pendulum rolls.

Referring to FIGS. 1-3, a small craft 10, such as a canoe, a small sailboat, or another boat with a narrow beam, ideally uses the actuators of this invention. A pair of fins 12 project downwardly from opposite sides of the craft 10 across the beam. Each fin 12 has an L-shaped arm 14 attached to its top end. The arms 14 connect the fins 12 to a means 16 for pivoting the fins simultaneously, such as a tie rod. A means 18 for actuating the simultaneous pivoting of the fins in response to the craft's listing is attached to the means 16 for pivoting. As best shown in FIG. 1, this means 18 is a pendulum having an arm **18*a* and roller 18*b* pivotally attached to the means 16. The roller 18*b* rolls in a dihedral 20, so that when the craft 10 is not listing, the pendulum comes to rest in the center. FIG. 7 shows a preferred configuration for the dihedral in which the angled planes 22 and 24 form only a portion of the platform for the roller 18*b***.

As shown in FIG. 2, as the craft 10 lists to starboard, the pendulum will roll to the right and will actuate the fins 12 to turn the forward faces to the right. This turning of the fins 12 will tend to reduce the list because of the forces generated by the change in the angle of attack of the fins 12.

Figure 4:
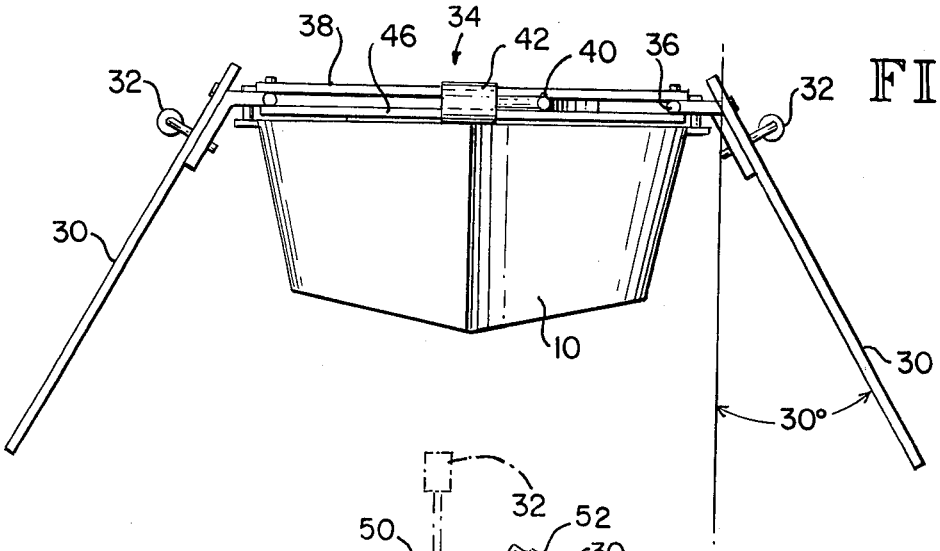
FIG. 4 is another elevation from the bow showing the fins suspended at a different angle.
Figure 5:
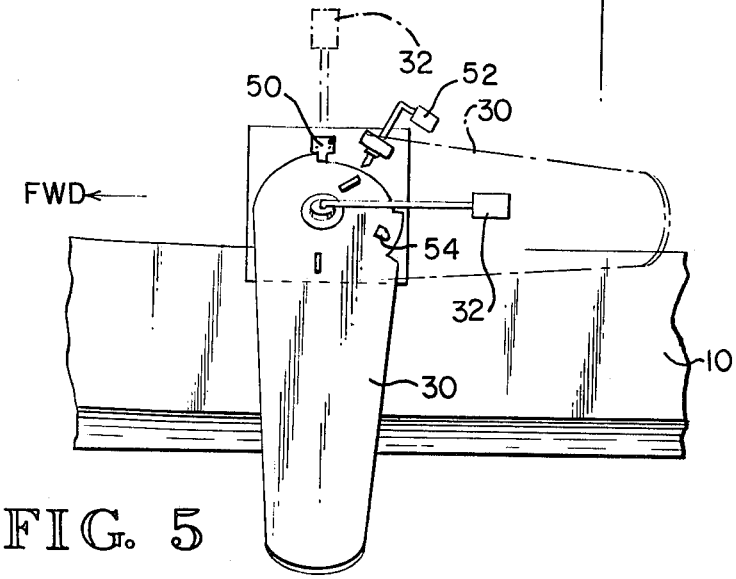
FIG. 5 is a side elevation of the actuators of FIG. 4, showing the retracted position of the fins in phantom.
Figure 6:
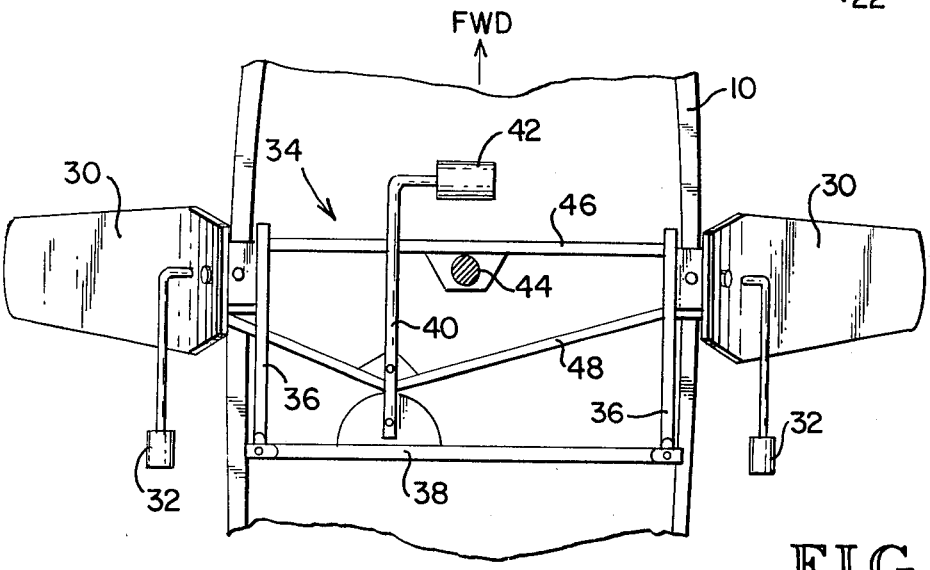
FIG. 6 is a top plan view of the boat of FIG. 4.

Referring now to FIGS. 4, 5 and 6, a second embodiment of the invention is illustrated. Two fins 30 extend downwardly from the gunwale of the craft 10 at about a 30° angle to the vertical. As with the fins of the first embodiment, these fins 30 are attached to a means 34 for pivoting them simultaneously when the craft 10 lists. The means 34 comprises side arms 36 releasably attached to the fins 30 and pivotally attached to a tie rod 38. Additional supports 46 and 48 may be used to add rigidity to the structure by connecting to the side arms 36 across the beam of the craft 10. Extending forwardly from the tie rod 38 and pivotally affixed thereto is a means for actuating the pivoting including an L-shaped shaft 40 and a weight 42 affixed to the end of the shaft 40. The means for actuating suspends above the deck of the craft and bends around the mast 44 to be in line with the centerline of the craft 10 when it travels without any listing. A handle 32 on each fin makes it easy to pivot the fin 30 into a horizontal orientation. As shown in FIG. 5 for a preferred fin 30, a stop 50 on the mounting plate for the fin on the craft's gunwale restricts rotation of the fin to about 90°. A stop rod 52 is similarly mounted and can be used to hold the fin 30 horizontal by pressing it downwardly beside a stop bar 54 on the fin 30. Thus, the fin 30 may be rotated from vertical to horizontal with the handle 32 and be locked in the horizontal position with the stop rod 52 and stop bar 54. Being able to retract the fins 30 is particularly useful when beaching the craft 10.

The fins 30 are wider aft of their pivot than ahead of it. This shape lessens the force necessary to deflect the fin when the craft lists. The fin seeks to follow the course of least resistance through the water. As designed, a simple means 34 for pivoting can be used to produce easy turning of the fins, yet with reasonable stability. Equal surfaces fore and aft of the pivot cancel each other when the fin is deflected. Only the remaining balance of area on the trailing edge requires force to deflect it. Thus a relatively light pendulum weight and relatively short pendulum arm may be used to produce the necessary torque to deflect the fins when the craft lists.

The fins improve performance when the craft is at rest also, because they serve as dampers to rolling of the craft. Sudden weight shifts produce a less dramatic effect.

While preferred embodiments of this invention have been shown and described, the invention is not intended to be so limited. Those skilled in the art will recognize numerous modifications that can be made without departing from this inventive concept. Therefore, the invention should not be limited to the preferred embodiments unless limitation is necessary in view of the prior art or the nature and spirit of the appended claims.

I claim:

1. Actuators for use with a small sailing craft to stabilize the craft and to provide self-righting capacity, comprising a pair of fins pivotally mounted and disposed on opposite sides of the craft, each fin extending downward below the hull of the craft to act like a centerboard, a tie rod connecting the fins to allow their simultaneous pivoting, and a pendulum for actuating the simultaneous pivoting when the craft lists to turn the fins through the tie rod so that the list of the craft will automatically be reduced.

2. The actuators of claim 1 wherein the fins are disposed substantially parallel to one another and substantially perpendicular to the beam of the craft.

3. The actuators of claim 1 wherein the fins are disposed so that the angle between them is about 60°.

4. The actuators of claim 1 wherein the fins are retractable from the water to allow easy beaching of the craft.

5. The actuators of claim 1 wherein the pendulum has a roller end which rolls in a dihedral as the craft lists.

6. The actuators of claim 1 wherein the fins are mounted so that the area of the fin behind the pivot axis is larger than the area in front of the pivot axis.

7. Actuators for use with a small sailing craft to stabilize the craft and to provide self-righting capacity, comprising:

(a) a pair of fins pivotally mounted and disposed on opposite sides of the craft, each fin extending downward below the hull of the craft to act like a centerboard, and adapted to stabilize the craft and to provide self-righting capacity for the craft;

(b) mechanical means connecting the fins and adapted for allowing the simultaneous pivoting of the fins; and (c) means for actuating the simultaneous pivoting of the fins when the craft lists, directly mechanically connected to the mechanical means connecting the fins, adapted to turn the fins so that the list of the craft will automatically be reduced, and including a horizontally projecting pendulum.

8. The actuators of claim 7 wherein the motion of the pendulum provides the sole motive power for pivoting the fins.

* * * * *